United States Patent [19]

Lötzer

[11] Patent Number: 4,991,517

[45] Date of Patent: Feb. 12, 1991

[54] SUSPENSION CONVEYOR SYSTEM

[75] Inventor: Karl Lötzer, Munich, Fed. Rep. of Germany

[73] Assignee: Veit Transpo GmbH, Landsberg, Fed. Rep. of Germany

[21] Appl. No.: 462,456

[22] Filed: Jan. 9, 1990

[30] Foreign Application Priority Data

Jan. 25, 1989 [DE] Fed. Rep. of Germany ..... 3902186

[51] Int. Cl.[5] ..... B61B 13/06; E01B 25/22

[52] U.S. Cl. ..... 104/165; 104/89

[58] Field of Search ..... 104/89, 91, 165; 198/465.4, 684; 57/90, 103, 281

[56] References Cited

U.S. PATENT DOCUMENTS 4,212,384 7/1980 Grube ..... 198/684

4,712,484 12/1987 Sticht ..... 104/165

4,856,270 8/1989 Langen et al. ..... 104/91

FOREIGN PATENT DOCUMENTS 2740594 3/1979 Fed. Rep. of Germany .

*Primary Examiner*—Robert P. Olszewski

*Assistant Examiner*—Alfred Muratori

*Attorney, Agent, or Firm*—Finnegan, Henderson, Farabow, Garrett & Dunner

[57] ABSTRACT

A suspension conveyor system including a plurality of carriers for conveying objects in suspended condition traveling on spaced, parallel rails, and a friction drive wheel located between every two of the carriers wherein the drive wheel is shiftable between a neutral position and first and second operating positions where it is in frictional engagement with one of the carriers.

7 Claims, 5 Drawing Sheets

SUSPENSION CONVEYOR SYSTEM

BACKGROUND OF THE INVENTION

The present invention relates to a suspension conveyor system and more particularly to a system for conveying objects such as bobbins for spinning machines.

Such a suspension conveyor system is known from German-Offenlegungsschrift 27 40 594. In the case of the known suspension conveyor system, the conveyor means includes a cross bar extending in the direction of transport. One side of the cross bar is acted upon by a friction wheel and the opposite side of the cross bar is acted upon by a counterpressure roller. The friction wheel has its own motor and is arranged at the side of the rail path of the suspension conveyor system. Friction drives are well adapted to be used for driving conveyor means of a suspension conveyor system, since they make comparatively little noise when they are in operation, since they show little susceptibility to trouble and since they can be controlled in a reliable manner. However, the disadvantage in the case of this type of drive means is that they require a great amount of space at the side of the rails as well as a comparatively high capital expenditure. These disadvantages are particularly important in cases in which the suspension conveyor system comprises a plurality of parallel rails positioned side by side in closely spaced relationship with one another. These are the conditions existing, for example, in spinning mills where bobbins suspended from conveyor means are to be transported. The bobbins have a comparatively small diameter so that, for example, the rails used for storage tracks could be arranged in comparatively close juxtaposition so as to save space. The known friction drive is, however, too expensive and too bulky for rails extending in close juxtaposition.

This will be particularly problematic in cases in which there is no possibility of enlarging the distance between the rails in view of structural circumstances, a situation which exists, for example, in the case of rail paths extending into the interior of a ring spinning frame. The known friction drive cannot be used for this purpose.

Hence, the present invention is based on the task of providing a suspension conveyor system which is provided with a friction drive for the conveyor means and which requires little space and is economy-priced.

SUMMARY OF THE INVENTION

This object is achieved in accordance with the present invention by providing a suspension conveyor system comprising at least two carriers for conveying objects in a suspended condition, said carriers traveling in parallel on spaced, parallel rails and each having a friction-engaging surface facing each other and extending parallel to the carrier's direction of travel, a friction wheel rotatably mounted between said carriers adjacent their friction-engaging surfaces, drive means for rotating said friction wheel, and shift means for shifting the friction wheel between a neutral position where it is not in frictional engagement with the surface of either carrier, a first operating position wherein it is in frictional engagement with the surface of one of said carriers and a second operating position where it is in frictional engagement with the surface of the other of said carriers.

Due to the structural design according to the present invention, it will now suffice to provide a single friction wheel for carriers travelling on two parallel rails, and said single friction wheel will, of course, only require one single motor. Hence, the capital expenditure can be reduced by one half and the existing space can be utilized in the best possible manner, since it is, for example, no longer necessary to accommodate the counterpressure roller of the neighboring drive together with the friction wheel of the first drive in an interspace between two rails. It follows that the distance between the juxtaposed rails can be reduced as much as this is possible with regard to the safety distance which has to be provided between the bobbins so as to avoid damage.

BRIEF DESCRIPTION OF THE DRAWINGS

In the following, one embodiment of the invention will be explained in detail on the basis of the drawings, in which.

DETAILED DESCRIPTION OF THE INVENTION

Figure 1:
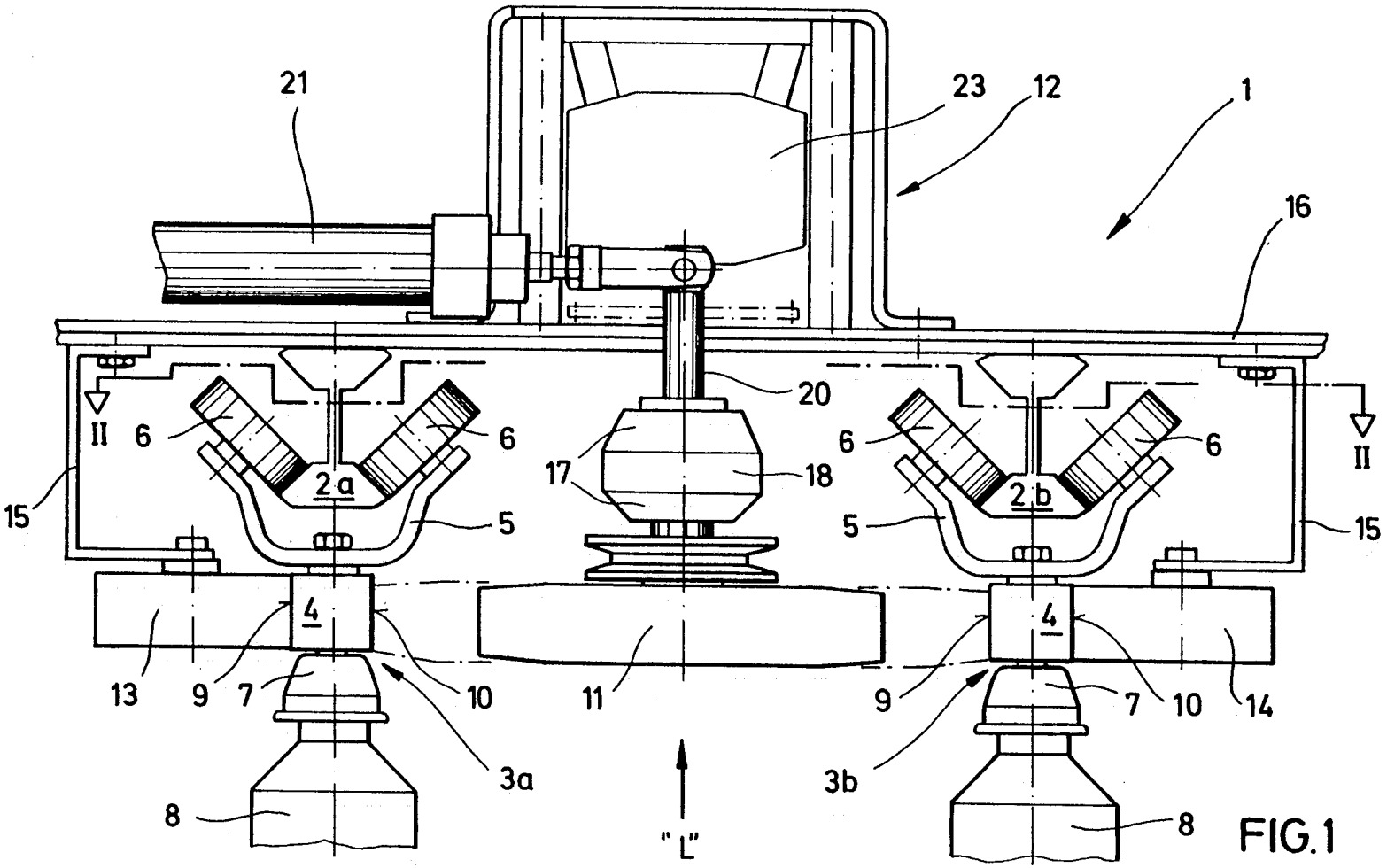
FIG. 1 shows a front view of a first embodiment of the invention.

FIG. 1 shows a first embodiment of a suspension conveyor system 1 according to the present invention, which includes a plurality of parallel rails 2, only two of said rails 2*a* and 2*b* being shown. Conveyor means or carries 3 travel on each of said rails, and in this case, too, only two of said conveyor means 3*a* and 3*b* are shown. Each of the conveyor means 3, which are known per se, includes a cross bar 4 having the form of an elongate profile bar. A travelling bow 5 is provided at each end of the cross bar 4, said travelling bows 5 being each supported on the running surfaces of the rail 2 via two rollers 6. Bobbins 8 are suspended from the cross bars 4 in the conventional manner, e.g. by means of suspension holders 7.

Each cross bar 4 is provided with two perpendicular force-application or friction-engaging surfaces 9 and 10 which face sidewards and in opposite directions and which extend parallel to the direction of transport. A friction wheel 11 of a friction drive 12 is arranged on the level of the force-application surfaces 9 and 10 in the condition in which the conveyor means 3 are suspended from the rail 2. The friction wheel 11 is located in the space between the cross bars 4 of the two conveyor means 3*a* and 3*b*; its diameter is, however, smaller than the distance between the two cross bars 4. A counterpressure roller 13, 14 is provided on each conveyor means side facing away from the friction wheel 11, said counterpressure rollers 13, 14 being in continuous contact with the associated force-application surfaces 9 and 10, respectively, of the associated cross bar. Each of the counterpressure rollers 13 and 14, respectively, is suspended from a support plate 16 via bows 15, and it will be expedient when also the rails 2 are secured to said support plate 16.

Figure 2:
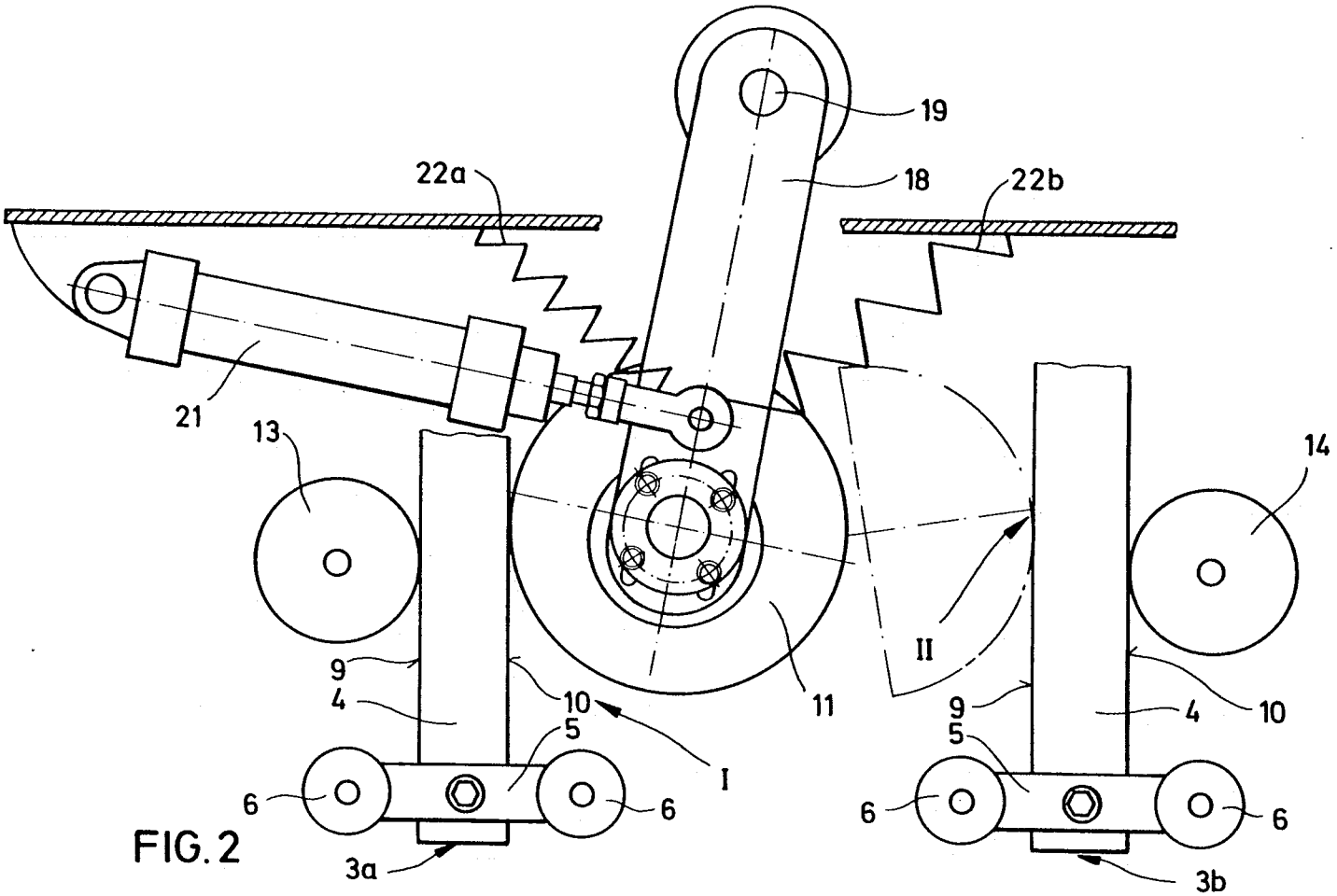
FIG. 2 shows a top view of FIG. 1 along line II—II.
Figure 3:
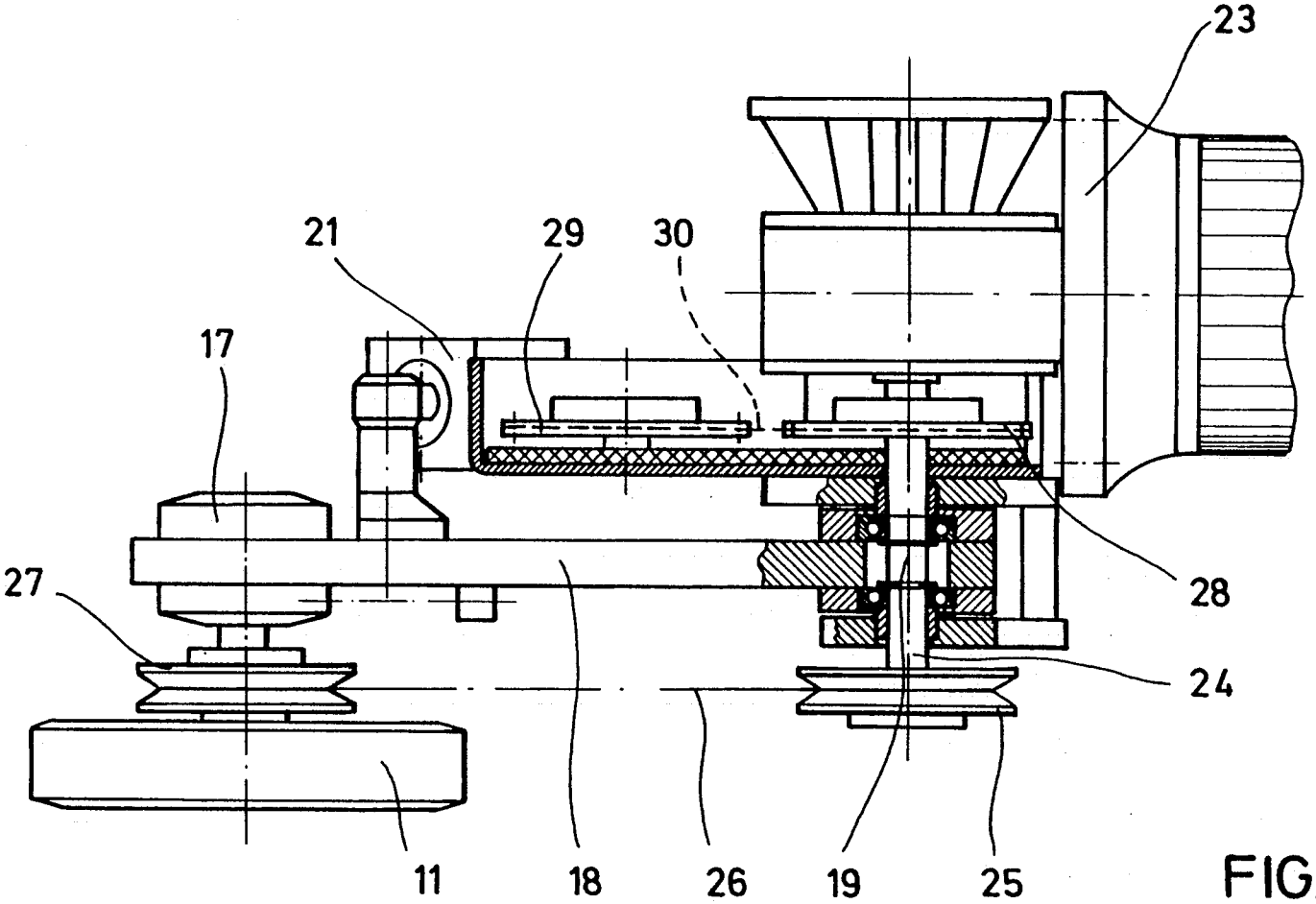
FIG. 3 shows a side view of an embodiment according to FIG. 1.

As can also be seen from FIGS. 2 and 3, the friction wheel 11 is, via a tensioning and adjusting knob 17, rotatably supported on one end of a lever arm 18. The other end of said lever arm 18 is adapted to be pivoted about a pivot shaft 19. A double-acting piston-cylinder arrangement 21 acts on the lever arm 18 via an extension pin 20. The use of a double-acting piston-cylinder arrangement in the shift means permits shifting of the friction wheel in a structurally simple, unproblematic manner. Furthermore, said lever arm 18 is acted upon by two equally strong springs 22*a* and 22*b*, which endeavour to hold the lever arm 18 parallel to the rails 2. Thus the neutral position of the double-acting piston-cylinder arrangement can be adjusted without any problems.

Figure 4:
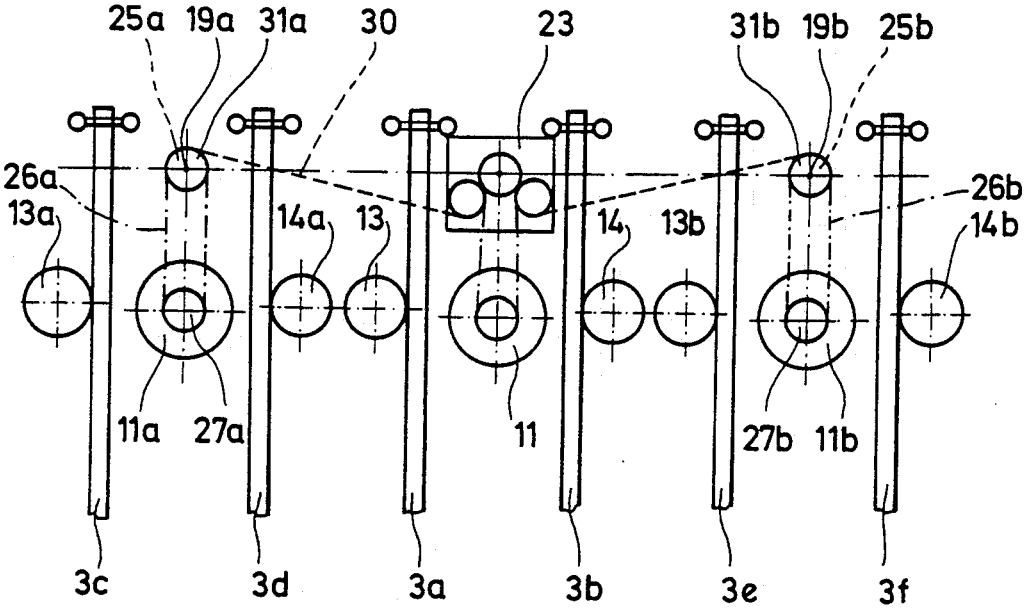
FIG. 4 shows a schematic representation of a top view of the suspension conveyor system according to the invention.
Figure 5:
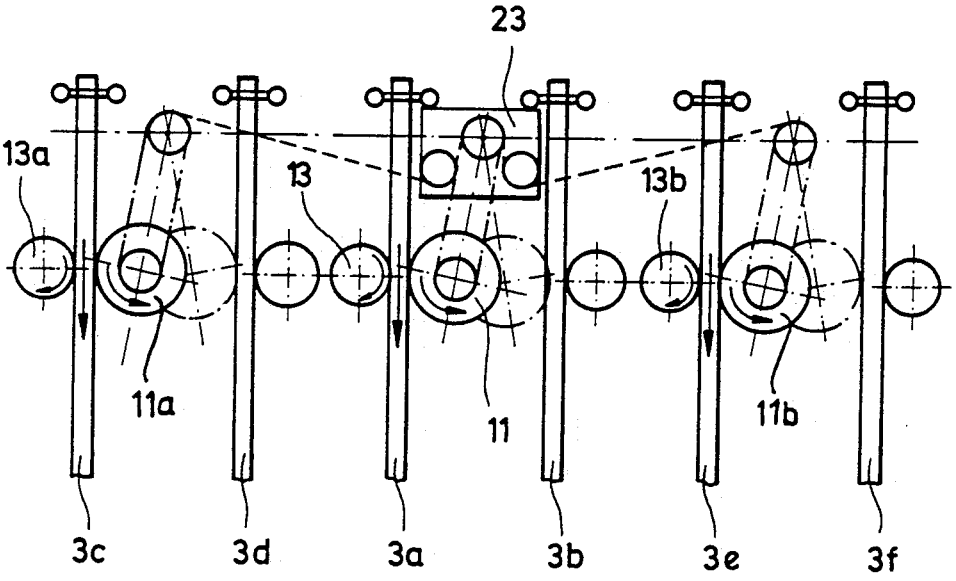
FIG. 5 shows a top view similar to that of FIG. 4, the friction wheels being in an operating position.

The friction drive 12 comprises a motor 23 including a drive shaft 24 extending coaxially with the pivot shaft 19 for the lever arm 18. The drive shaft 24 has secured thereto a V-belt pulley 25 transmitting the driving force via a V-belt 26, which is only outlined by a dot-and-dash line, to a V-belt pulley 27 fixedly connected to the friction wheel 11. The driving force is additionally transmitted to a chain wheel 28 driving a chain 30, which is represented by a dot-and-dash line and which extends round two deflection chain wheels 29. As can be seen from FIG. 4 and 5, the chain 30 drives additional friction wheels 11*a* and 11*b*, which are adapted to be pivoted about lever arms (not shown), each of said friction wheels 11*a* and 11*b* being—analogously with the friction wheel 11—located between two conveyor means 3*c*, 3*d* and 3*e*, 3*f*, respectively, said conveyor means travelling on rails, which extend parallel to the rails 2*a* and 2*b* and which are not shown. As can be seen in FIG. 4 and 5, friction wheels are arranged only in every other space between two conveyor means 3*a*, 3*b* and 3*c*, 3*d* and 3*e*, 3*f*, whereas the other spaces accommodate the counterpressure rollers 13, 13*a*, 13*b* and 14, 14*a*, 14*b*, which are provided with a substantially smaller structural design and the diameter of which is variable. Each of the two additional friction wheels 11*a*, 11*b* is connected to a V-belt pulley 27*a*, 27*b* driven via a V-belt 26*a*, 26*b* by a V-belt pulley 25*a*, 25*b*, the axes of said V-belt pulleys 25*a*, 25*b* being coaxial with the pivot shafts 19*a*, 19*b* for the friction wheels 11*a*, 11*b*. Also chain wheels 31*a*, 31*b* are fixedly connected to the V-belt pulleys 25*a*, 25*b* and arranged such that they are coaxial with the pivot shafts 19*a* and 19*b*, respectively, said chain wheels 31*a*, 31*b* being driven by the motor 23 via the chain 30. Although only three friction wheels are shown in the drawing, it is obvious that it is also possible to drive four or even more friction wheels by means of a single motor.

In FIG. 1 and 4, each of the friction wheels 11 occupies a neutral position L, i.e. the friction wheel 11 is not in engagement with any of the force-application surfaces 9 or 10 of the cross bar 4 of a conveyor means. When, for example, the conveyor means 3*a* is to be driven, the piston-cylinder arrangement 21 is actuated, whereupon it will pivot the lever arm 18 to the left in FIG. 2 against the force of the springs 22*a* and 22*b*, respectively, until the friction wheel 11 is located in a first operating position I in frictional engagement with the force-application surface 10 of the cross bar 4 of the conveyor means 3*a* and presses the opposite force-application surface 9 against the counterpressure roller 13. When the friction wheel 11 is now driven, the conveyor means 3*a* will be moved. When the conveyor means 3*b* is to be driven, the piston-cylinder arrangement 21 will again be actuated until the friction wheel 11 is located in the second operating position II, indicated by a dot-and-dash line, where it will be in engagement with the force-application surface 9 of the cross bar 4 of the conveyor means 3*b* and press the opposite force-application surface 10 of the conveyor means 3*b* against the counterpressure roller 14. If none of the two conveyor means 3*a*, 3*b* is to be driven, the pressure applied to the piston-cylinder arrangement 21 is taken away so that, due to the effect produced by the equally strong springs 22*a*, 22*b*, the lever arm 18 will be pivoted back to the neutral position L where it extends essentially parallel to the conveyor means arranged on both sides thereof and where the friction wheel 11 is positioned in spaced relationship with the respective force-application surfaces 10 and 9 of the cross bars on both sides. As can be seen from FIG. 5, all friction wheels 11, 11*a*, 11*b* of a suspension conveyor system 1 can simultaneously be pivoted into the same direction so that every other conveyor means 3*a*, 3*c* and 3*e* between the respective friction wheels 11, 11*a*, 11*b* and the respective associated counterpressure rollers 13, 13*a*, 13*b* is transported. However, on the basis of the described mode of guiding the chain and the V-belts, it is also easily possible to choose the conveyor means to be transported arbitrarily.

Figure 6:
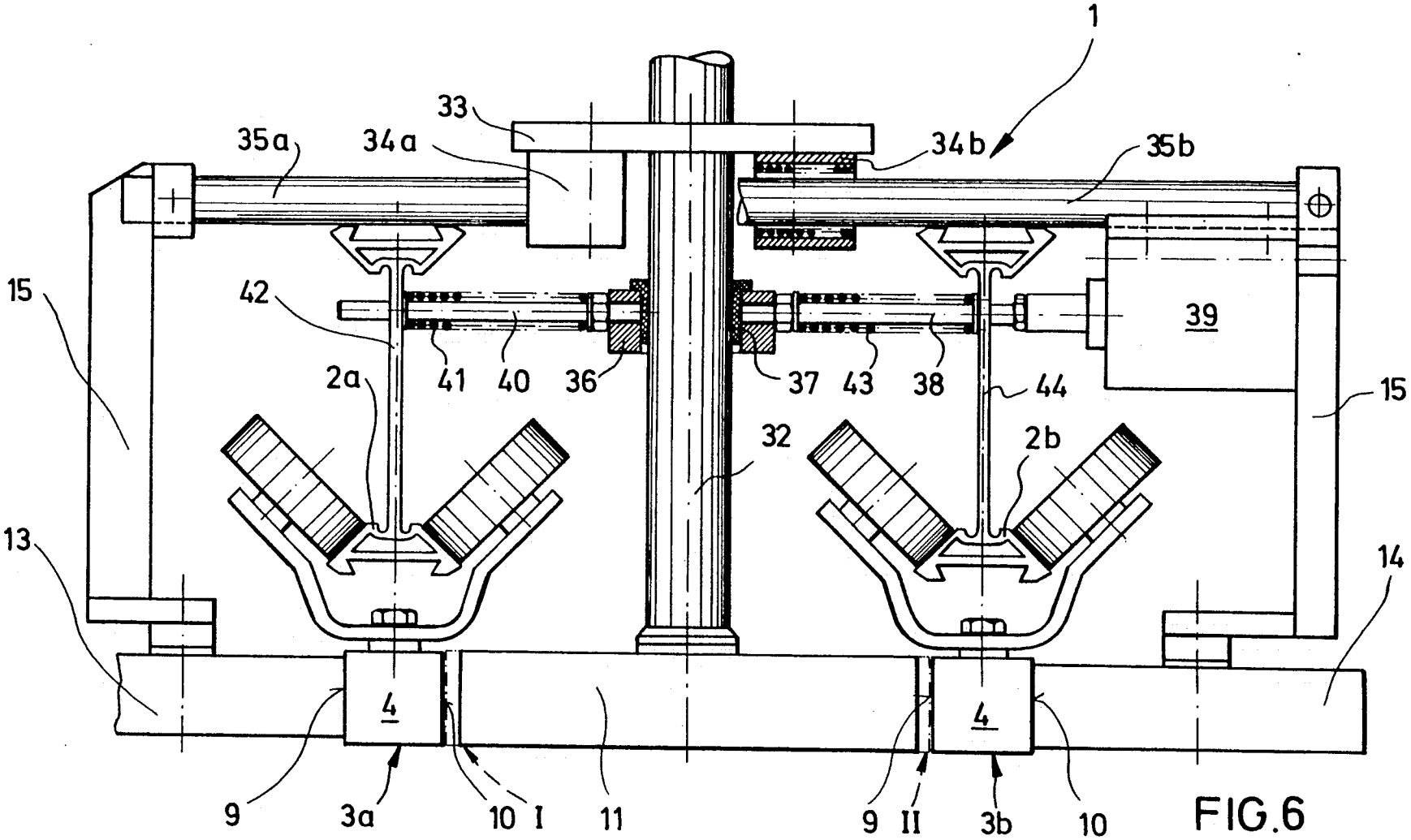
FIG. 6 shows a front view of an additional embodiment.

FIG. 6 shows a second embodiment of a suspension conveyor system 1' according to the present invention; using identical reference numerals for identical or comparable components, this second embodiment will be explained in detail hereinbelow. Also the suspension conveyor system 1' is provided with two rails 2*a* and 2*b* which extend in parallel and on which the conveyor means 3*a*, 3*b* described hereinbefore travel. A counterpressure roller 13, which is secured to a bow 15, is in engagement with the force-application surface 9 of the cross bar 4 of the conveyor means 3*a*; and a counterpressure roller 14, which is secured to a bow 15, is in engagement with the force-application surface 10 of the cross bar 4 of the conveyor means 3*b*. The friction wheel 11, occupying its neutral position L, is shown in the middle between the cross bars 4 of the conveyor means 3*a* and 3*b*.

The shaft 32 of the friction wheel 11 is rotatably supported in a flange 33. The flange 33 is provided with two sleeves 34*a*, 34*b* by means of which said flange 33 is slidingly guided on two parallel guide rods 35*a* and 35*b* extending transversely to the direction of transport. In FIG. 6, the guide rods 35*a*, 35*b* are arranged one after the other, at right angles to the plane of the drawing, and in spaced relationship with each other; for the sake of clarity, both guide rods have been shown in a broken representation so as to show the shaft 32 which is adapted to be displaced in the space between said guide rods. The shaft 32 is driven in a manner known, e.g. via a chain drive, by a motor which is not shown in the drawing either. A displacement sleeve 36 is arranged around the shaft 32; said displacement sleeve 36 itself is stationary, but it supports the rotating shaft 32 by means of a slide lining 37. The displacement sleeve 36 has secured thereto a piston rod 38 of a double-acting piston-cylinder arrangement 39. An additional rod 40 is secured to the displacement sleeve 36 on the displacement sleeve side which is located diametrically opposite the point of application of the piston rod 38, said additional rod 40 resting via a spring 41 on a support surface, e.g. on a web 42, of the rail 2*a*. The other end of the spring 41 rests on the displacement sleeve 36. An equally strong spring 43 surrounds the piston rod 38 and rests also on the displacement sleeve 36 and on a web 44 of the rail *2b*.

When the double-acting piston-cylinder arrangement 39 is actuated so as to drive the conveyor means *3a*, the piston rod 38 will be extended to the left in FIG. 6, and, via the displacement sleeve 36, it will displace the shaft 32 with its flange 33 via the sliding sleeves 34*a* and 34*b* linearly on the guide rods 35*a* and 35*b* until the friction wheel 11 comes into engagement with the force-application surface 10 of the cross bar 4 of the conveyor means *3a* in the operating position I, whereupon said conveyor means *3a* will be driven between the counter-pressure roller 13 and the friction wheel 11. When the friction wheel 11 is to be displaced to the right in FIG. 6 so as to occupy operating position II, the piston rod 38 is retracted and the shaft 32 is linearly displaced to the right. When the friction wheel 11 is to be returned to the neutral position L from one of its operating positions I and II, respectively, the pressure applied to the piston-cylinder arrangement is taken away so that the piston rod 38 can be moved to the central position, i.e. the neutral position, by means of the equally strong springs 41 and 43, respectively. As can be seen from FIG. 6, the rod 40 can extend through the web 42 of the rail *2a* in a manner corresponding to that which has already been shown in connection with the piston rod 38 and the web 44. It is thus possible to transmit the movement of the piston-cylinder arrangement 39 to one or to several neighbouring friction wheel shafts so that, analogously with the representation in FIG. 5, every other conveyor means can be moved alternately.

As a modification of the embodiments which have been described and which are shown in the drawings, also other shift means, e.g. a gear and a pinion or the like, can be used. The chain and V-belt transmissions can be replaced by other expedient transmission means.

I claim:

1. A suspension conveyor system comprising at least two carriers for conveying objects in a suspended condition, said carriers traveling on spaced, parallel rails and each having a friction-engaging surface facing each other and extending parallel to the carrier's direction of travel, a friction wheel rotatably mounted between said carriers adjacent their friction-engaging surfaces, drive means for rotating said friction wheel, and shift means for shifting the friction wheel between a neutral position where it is not in frictional engagement with the surface of either carrier, a first operating position wherein it is in frictional engagement with the surface of one of said carriers and a second operating position where it is in frictional engagement with the surface of the other of said carriers.

2. The suspension conveyor of claim 1, wherein the shift means includes a lever arm pivotably mounted about a pivot shaft, which arm carries the friction wheel, and means for pivoting the level arm to shift the wheel between its three positions.

3. The suspension conveyor system of claim 1, wherein the friction wheel is rotatably mounted on a shaft and the shift means includes a slide guide means for shifting the shaft and friction wheel between its three positions in a direction perpendicular to the carrier's direction of travel.

4. The suspension conveyor system of any one of claims 1 to 3, wherein the shift means includes a double-acting piston-cylinder for shifting the wheel between its three positions.

5. The suspension conveyor system of any one of claims 1 to 3, including spring means for biasing the friction wheel to its neutral position.

6. The suspension conveyor system of claim 1, comprising a plurality of carriers traveling in parallel on a plurality of spaced, parallel rails with a friction wheel rotatably mounted between every two of said carriers.

7. The suspension conveyor system of claim 6, wherein the drive means includes a single motor which drives all of the friction wheels.

* * * * *